US008750730B2

(12) United States Patent
Hewitt et al.

(10) Patent No.: US 8,750,730 B2
(45) Date of Patent: Jun. 10, 2014

(54) METHOD AND APPARATUS FOR ELECTRONIC FUSER ASSEMBLY LABELING

(75) Inventors: Paul Hewitt, Allington (GB); Mark Okley, Wrestlingworth (GB); David William Bailey, New Thundersley (GB); David Brett, Enfield (GB); Adrian Robert Tanner, Dunstable (GB); Anthony Geoffrey Painter, Pilgrims Hatch (GB)

(73) Assignee: Xerox Corporation, Norwalk, CT (US)

( * ) Notice: Subject to any disclaimer, the term of this patent is extended or adjusted under 35 U.S.C. 154(b) by 189 days.

(21) Appl. No.: 13/529,670

(22) Filed: Jun. 21, 2012

(65) Prior Publication Data

US 2013/0343770 A1 Dec. 26, 2013

(51) Int. Cl.
*G03G 15/00* (2006.01)

(52) U.S. Cl.
USPC ..... 399/12; 399/45; 399/67

(58) Field of Classification Search
USPC ..... 399/9, 12, 38, 45, 67–69
See application file for complete search history.

(56) References Cited

U.S. PATENT DOCUMENTS 8,571,456 B2 * 10/2013 Samei et al. ..... 399/328

* cited by examiner

*Primary Examiner* — Hoan Tran
(74) *Attorney, Agent, or Firm* — Ronald E. Prass, Jr.; Prass LLP

(57) ABSTRACT

An approach is provided for pairing a fuser assembly with a media size and for electronically labeling the fuser assembly for use with the media size. The approach involves causing, at least in part, a fuser assembly having a memory to be tagged with an identifier related to a corresponding media size, the identifier being stored in the memory. The approach also involves determining a media size associated with a print job to be run by a printing system. The approach further involves determining the identifier of an installed fuser assembly. The approach additionally involves causing, at least in part, a comparison between the determined media size associated with the print job and the identifier of the installed fuser assembly to determine if a conflict exists.

21 Claims, 5 Drawing Sheets

METHOD AND APPARATUS FOR ELECTRONIC FUSER ASSEMBLY LABELING

FIELD OF DISCLOSURE

The disclosure relates to an apparatus, method and system for pairing a fuser assembly useful in printing with a media size and electronically labeling the fuser assembly for use with the media size.

BACKGROUND

Some printing systems employ a multi-fuser strategy in which a printing system may be configured to accommodate various media sizes such as A4, A3, SRA3, etc. by employing a specifically size-designated fuser assembly to print an image onto a substrate. For example, one fuser assembly may be allocated for A3, another for SRA3, and one for A4. This strategy ensures fuser part costs are kept to a minimum because, as fuser assemblies wear over time, paper edge wear marks often occur. As such, users often assign fuser assemblies to particular media sizes and change fuser assemblies each time a different media size is in production. Users must remember which assembly corresponds to a particular media size. This creates an opportunity to mistakenly use a fuser assembly labeled for A4 paper during a print job that is configured to run A3 paper, for example. As a result, production print runs often have print quality defects such as "tram lines" running from a lead edge to a trail edge of a the media. This results in wasted production resources, lost time, and production process inefficiency caused by system downtime.

SUMMARY

Therefore, there is a need for an approach for pairing a fuser assembly with a media size and electronically labeling the fuser assembly for use with the media size.

According to one embodiment, a method comprises causing, at least in part, a fuser assembly having a memory to be tagged with an identifier related to a corresponding media size, the identifier being stored in the memory. The method also comprises determining a media size associated with a print job to be run by a printing system. The method further comprises determining the identifier of an installed fuser assembly. The method additionally comprises causing, at least in part, a comparison between the determined media size associated with the print job and the identifier of the installed fuser assembly to determine if a conflict exists.

According to another embodiment, an apparatus comprises at least one processor, and at least one memory including computer program code for one or more computer programs, the at least one memory and the computer program code configured to, with the at least one processor, cause, at least in part, the apparatus to cause, at least in part, a fuser assembly having a memory to be tagged with an identifier related to a corresponding media size, the identifier being stored in the memory. The apparatus is also caused to determine a media size associated with a print job to be run by a printing system. The apparatus is further caused to determine the identifier of an installed fuser assembly. The apparatus is additionally caused to cause, at least in part, a comparison between the determined media size associated with the print job and the identifier of the installed fuser assembly to determine if a conflict exists.

According to another embodiment, a computer-readable storage medium carries one or more sequences of one or more instructions which, when executed by one or more processors, cause, at least in part, an apparatus to cause, at least in part, a fuser assembly having a memory to be tagged with an identifier related to a corresponding media size, the identifier being stored in the memory. The apparatus is also caused to determine a media size associated with a print job to be run by a printing system. The apparatus is further caused to determine the identifier of an installed fuser assembly. The apparatus is additionally caused to cause, at least in part, a comparison between the determined media size associated with the print job and the identifier of the installed fuser assembly to determine if a conflict exists.

Exemplary embodiments are described herein. It is envisioned, however, that any system that incorporates features of any apparatus, method and/or system described herein are encompassed by the scope and spirit of the exemplary embodiments.

BRIEF DESCRIPTION OF THE DRAWINGS

The embodiments of the invention are illustrated by way of example, and not by way of limitation, in the figures of the accompanying drawings.

DETAILED DESCRIPTION

Examples of a method, apparatus, and computer program for pairing a fuser assembly with a media size and electronically labeling the fuser assembly for use with the media size are disclosed. In the following description, for the purposes of explanation, numerous specific details are set forth in order to provide a thorough understanding of the embodiments of the invention. It is apparent, however, to one skilled in the art that the embodiments may be practiced without these specific details or with an equivalent arrangement. In other instances, well-known structures and devices are shown in block diagram form in order to avoid unnecessarily obscuring the embodiments.

As used herein, the term media size relates to one or more dimensions such as width, length, or thickness of a substrate that is to be processed by a printing system.

As used herein, the term "print job" relates to a production run of one or more sheets to which an image is to be applied during a printing or copying process.

Figure 1:
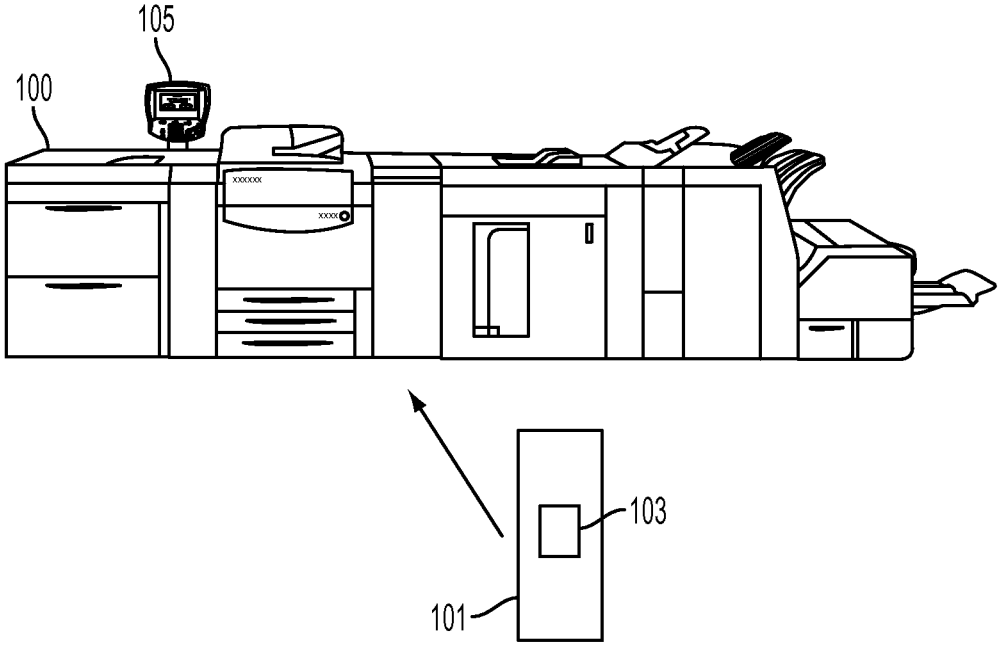
FIG. 1 is a diagram of a system capable of pairing a fuser assembly with a media size and electronically labeling the fuser assembly for use with the media size, according to one embodiment.

FIG. 1 is a diagram of a system capable of pairing a fuser assembly with a media size and electronically labeling the fuser assembly for use with the media size, according to one embodiment. Some printing systems employ a multi-fuser strategy in which a printing system may be configured to accommodate various media sizes such as A4, A3, SRA3, etc.

by employing a specifically size-designated fuser assembly to print an image onto a substrate. For example, one fuser assembly may be allocated for A3, another for SRA3, and one for A4. This strategy ensures fuser part costs are kept to a minimum because, as fuser assemblies wear over time, paper edge wear marks often occur. As such, users often assign fuser assemblies to particular media sized and change fuser assemblies each time a different media size is in production. Users must remember which assembly corresponds to a particular media size, which creates an opportunity to mistakenly use a fuser assembly labeled for A4 paper during a print job that is configured to run A3 paper, for example. As a result, production print runs often have print quality defects such as "tram lines" running from a lead edge to a trail edge of a the media. This causes wasted both production resources, lost time, and production process inefficiencies caused by system downtime.

To address this problem, a system 100 of FIG. 1 introduces the capability to pair a fuser assembly with a media size and electronically label the fuser assembly for use with the media size. The system 100 is a printer or a copier that fuses an ink or toner image to a substrate using a fuser assembly 101. The fuser assembly 101 has a memory 103 that may be any type of storage device that can store data. In some embodiments, the memory 103 may be a customer replaceable unit monitor which is a type recording device that enables a user to program the memory 103. In embodiments, the system 100 is configured to label a fuser assembly 101 with an identifier stored in the memory that specifically associates the fuser assembly 101 with a media size. For example, a fuser assembly may be labeled to be associated with A3 paper, A4 paper, SRA3 paper, etc. The system 100, in some embodiments, comprises a user interface 105 that may comprise, for example, a drop down menu that includes preset media sizes. In embodiments, the user interface 105 may include a custom menu for inputting customized information to label a fuser assembly 101.

According to various embodiments, fuser assembly 101 having the memory 103 may be installed into the system 100 and electronically labeled by storing an identifier in the memory 103 so that the fuser assembly 101 will be associated with a specific media size. The fuser assembly 101 may then be removed from the system 100 if a print job using a different media size is to be run by the system 100. Each time the fuser assembly 101 is changed, the system 100 determines what media size, e.g. paper stock, is to be used on a production run and compares it to identifier stored in the memory 103 that is on a fuser assembly 101 installed in the system 100 before a print job is to occur. In the event there is a conflict, the system 100, in some embodiments, may generate an error message that indicates a mismatch exists between the media size that is to be run by the print job and the fuser assembly 101 that is installed in the system 100.

In one or more embodiments, the error message may appear on the user interface 105, and may indicate that a incorrect fuser assembly 101 is installed, instruct a user to change out the fuser assembly 101, and to install another fuser assembly 101 that has been identified to correspond to the determined media size associated with the print job that is to be run. Alternatively, the system 100 may simply not allow the print job to occur without a user override. In either case, by preventing the print job from occurring without a correct fuser assembly 101 being installed in the system 100 based on the comparison between the identifier stored on the memory 103 and the media size associated with the print job, no print production wasted.

According to various embodiments, the system 100 may be configured to determine whether a fuser assembly 101 has reached its usable life for printing media of a particular size. For example, the system 100 may be preset to estimate a number of sheets that a fuser assembly 101 may be used for before beginning to fail. Alternatively, the system 100 may sense, by way of a sensor, an imaging performance and determine a degradation in image quality over time. As such, when the system 100 determines that the fuser assembly 101 reaches its lifetime limit for a particular media size to which it had been assigned, the system 100 may suggest, by way of the user interface 105, for example, that the fuser assembly 101 be used for a smaller media size. If used for a smaller media size, any tram lines, for example, that may occur because of a used up fuser assembly 101 may not occur when fusing an image for a print run that requires as smaller media size than one that the fuser assembly 101 was previously associated with.

For example, if a fuser assembly 101 was tagged to be identified as being associated with a media size of SRA3, the system 100 may suggest that the fuser assembly 101 be used for a media size such as an A3 or A4 paper for future production. If re-used for smaller media sizes, the lifetime of the fuser assembly 101 may be extended, thereby significantly reducing the overall costs for using fuser assemblies and reducing waste. If the fuser assembly 101 is to be re-used for a smaller media size after its usable life has been reached for a larger media size, the system 100 may enable the fuser assembly to be re-labeled by changing its identifier in stored in the memory 103 so that the fuser assembly 101 is associated with the different, smaller, media size. In some embodiments, the re-labeling may be done by way of the user interface 105, or the system 100 may simply be pre-programmed to do this automatically to optimize fuser assembly life without user interaction.

Figure 2:
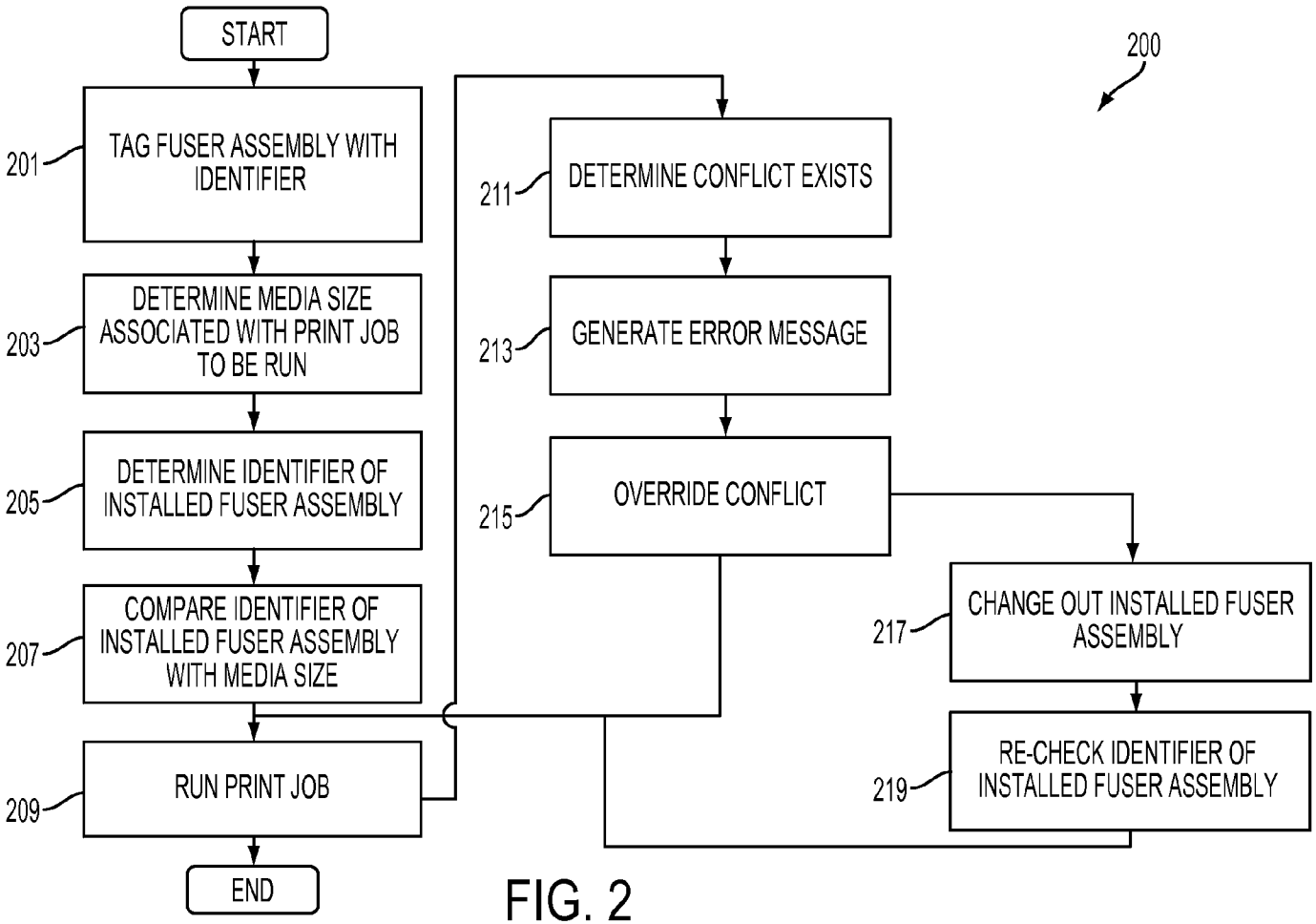
FIG. 2 is a flowchart of a process for pairing a fuser assembly with a media size and electronically labeling the fuser assembly for use with the media size, according to one embodiment.
Figure 5:
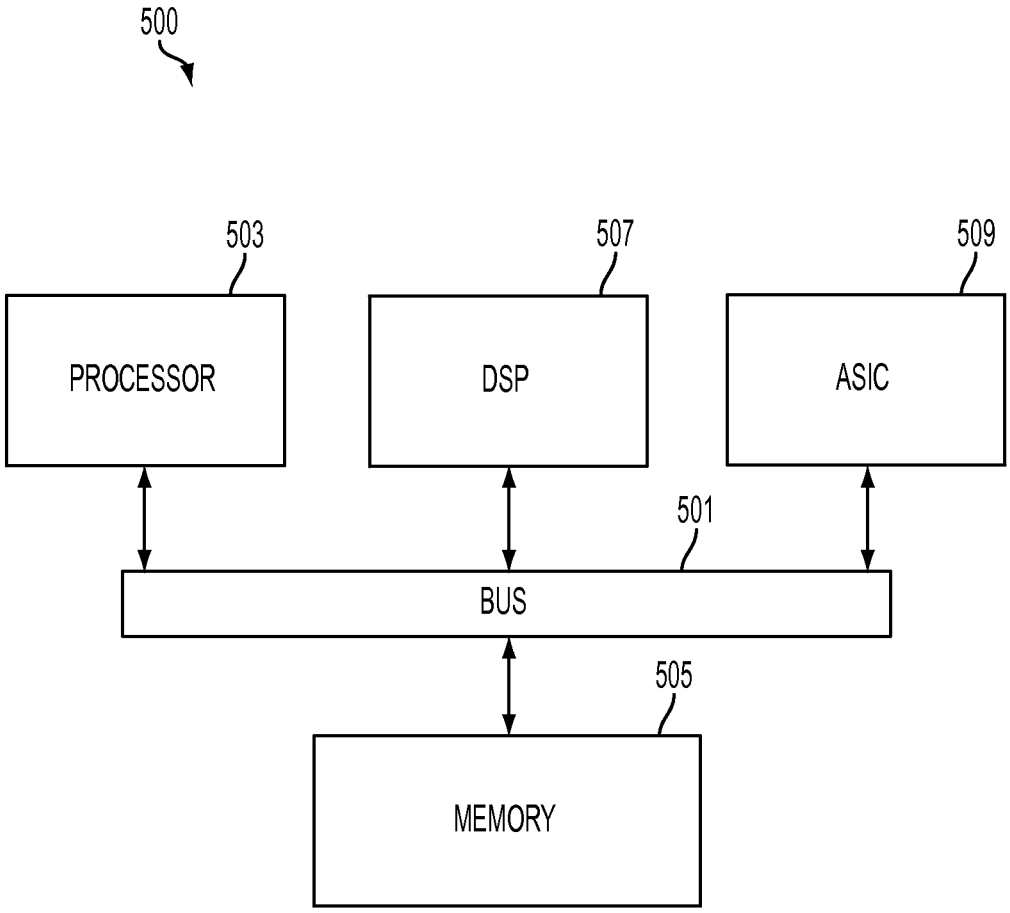
FIG. 5 is a diagram of a chip set that can be used to implement an embodiment.

FIG. 2 is a flowchart of a process for pairing a fuser assembly with a media size and electronically labeling the fuser assembly for use with the media size, according to one embodiment. In one embodiment, the system 100 performs the process 200 and may comprise a control module implemented in, for example, a chip set including a processor and a memory as shown in FIG. 5. In step 201, the system 100 causes, at least in part, a fuser assembly 101 having a memory 103 to be tagged with an identifier related to a corresponding media size, the identifier being stored in the memory 103. The memory 103 may be, as discussed above, any form of memory that can store data such as, but not limited to, a customer replaceable unit monitor. As discussed above, in one or more embodiments, the fuser assembly 101 is tagged with the identifier by way of a user interface 105. Then, in step 203, the system 100 determines a media size associated with a print job to be run by a printing system 100. For example, the print job may require A4 paper, A3, paper, or any other identifiable size paper. Next, in step 205, the system 100 determines the identifier of an installed fuser assembly 101. After tagging the fuser assembly 101 with an identifier, the fuser assembly 101, or another fuser assembly 101 may be removed and/or installed in the system 100, as discussed above. The process continues to step 207 in which the system 100 causes, at least in part, a comparison between the determined media size associated with the print job and the identifier of the installed fuser assembly 101 to determine if a conflict exists. If a conflict does not exist, the print job may be run in step 209.

However, if the system 100 determines a conflict does exist in step 211, the process continues to step 213. In step 213, the system 100 causes, at least in part, an error message to be generated indicating that the conflict exists between the installed fuser assembly and the media size associated with the print job. As discussed above, the error message may be provided by way of the user interface 105, or may be provided by a system beep, or simply by not allowing the print job to occur. Next, in step 215, the system 100 may enable the conflict to be overridden to enable the print job to occur regardless of the identifier of the fuser assembly 101 that is installed. Or, in step 217, the system 100 may recheck the identifier of the fuser assembly 101 if the fuser assembly 101 is removed and replaced with another fuser assembly 101 that fits the media size of the print job that is to be run. Then, in step 219, the system 100 may cause the print job to be run.

Figure 3:
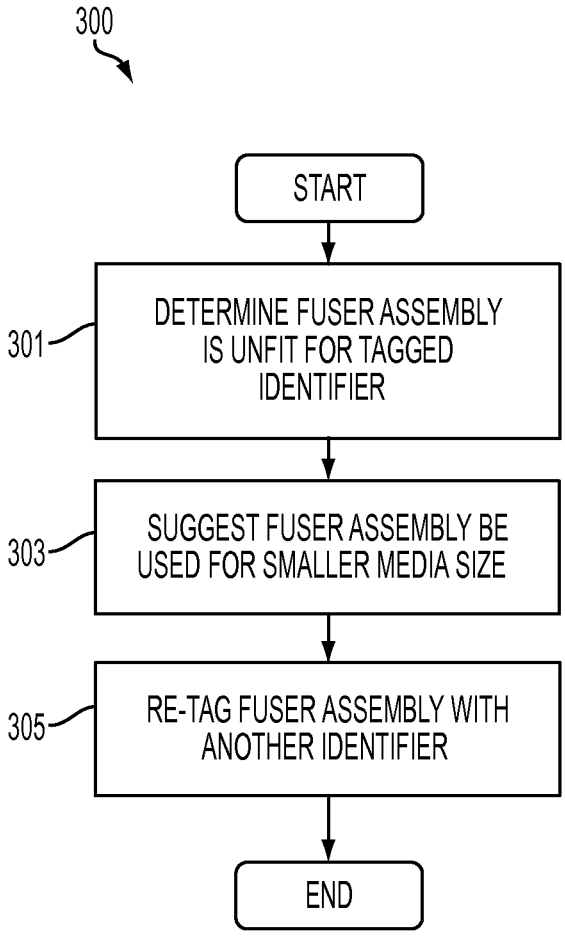
FIG. 3 is a flowchart of a process for pairing a fuser assembly with a media size and electronically labeling the fuser assembly for use with the media size after the fuser assembly is deemed unfit for its initially paired media size, according to one embodiment.

FIG. 3 is a flowchart of a process for pairing a fuser assembly with a media size and electronically labeling the fuser assembly for use with the media size, according to one embodiment. In one embodiment, the system 100 performs the process 300 and may comprise a control module implemented in, for example, a chip set including a processor and a memory as shown in FIG. 5. In step 301, the system 100 determines the installed fuser assembly 101 is unfit for the media size associated with the tagged identifier. Then, in step 303, the system 100 causes, at least in part, a suggestion message to be generated to use the installed fuser assembly 101 for another media size that is smaller than the media size associated with the tagged identifier. Next, in step 305, the system 100 causes, at least in part, the fuser assembly 101 to be re-tagged with another identifier related to the another media size, the another identifier being stored in the memory 103. As discussed above, the fuser assembly 101 may be re-tagged by way of a user interface.

Figure 4:
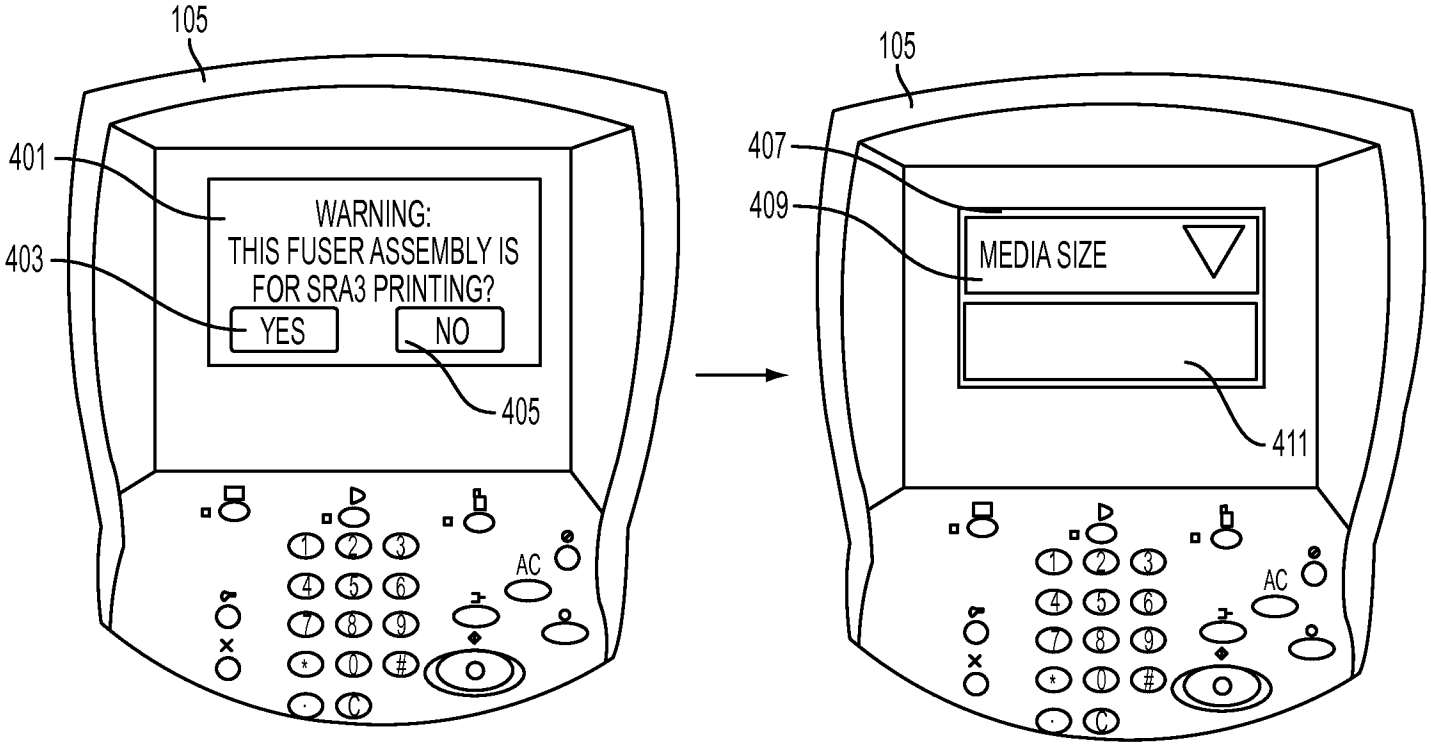
FIG. 4 are diagrams of user interfaces utilized in the processes of FIG. 2, according to various embodiments.

FIG. 4 is a diagram of a an example user interface 105 utilized in the processes of FIG. 2, according to various embodiments. As discussed above, the user interface 105 may present an error message 401 in the event a conflict is determined between the tagged identifier of an installed fuser assembly 101 and the determined media size associated with a print job that is to be run. If a conflict occurs, the error message 401 may indicate that the conflict exists and ask a user to select to override the conflict by way of an override selection 403 on the user interface 105, or cancel the print job and optionally change the fuser assembly 101 by selecting a cancel option 405.

In one or more embodiments, the user interface 105 is changeable to provide, as discussed above, a tagging screen 407 for tagging an installed fuser assembly 101 to be identified as being associated with a particular media size. In embodiments, the tagging screen 409 includes a drop-down box 409 that has preset media sizes that may be selected to be assigned to an installed fuser assembly 101 and stored as an identifier on its memory 103, or a custom field 411 may be provided to enable a user to assign any custom tag to the fuser assembly 101 when it is installed as the identifier.

The processes described herein for pairing a fuser assembly with a media size and electronically labeling the fuser assembly for use with the media size may be advantageously implemented via software, hardware, firmware or a combination of software and/or firmware and/or hardware. For example, the processes described herein, may be advantageously implemented via processor(s), Digital Signal Processing (DSP) chip, an Application Specific Integrated Circuit (ASIC), Field Programmable Gate Arrays (FPGAs), etc. Such exemplary hardware for performing the described functions is detailed below.

FIG. 5 illustrates a chip set or chip 500 upon which an embodiment may be implemented. Chip set 500 is programmed to pair a fuser assembly with a media size and electronically labeling the fuser assembly for use with the media size as described herein may include, for example, bus 501, processor 503, memory 505, DSP 507 and ASIC 509 components.

The processor 503 and memory 505 may be incorporated in one or more physical packages (e.g., chips). By way of example, a physical package includes an arrangement of one or more materials, components, and/or wires on a structural assembly (e.g., a baseboard) to provide one or more characteristics such as physical strength, conservation of size, and/or limitation of electrical interaction. It is contemplated that in certain embodiments the chip set 500 can be implemented in a single chip. It is further contemplated that in certain embodiments the chip set or chip 500 can be implemented as a single "system on a chip." It is further contemplated that in certain embodiments a separate ASIC would not be used, for example, and that all relevant functions as disclosed herein would be performed by a processor or processors. Chip set or chip 500, or a portion thereof, constitutes a means for performing one or more steps of pairing a fuser assembly with a media size and electronically labeling the fuser assembly for use with the media size.

In one or more embodiments, the chip set or chip 500 includes a communication mechanism such as bus 501 for passing information among the components of the chip set 500. Processor 503 has connectivity to the bus 501 to execute instructions and process information stored in, for example, a memory 505. The processor 503 may include one or more processing cores with each core configured to perform independently. A multi-core processor enables multiprocessing within a single physical package. Examples of a multi-core processor include two, four, eight, or greater numbers of processing cores. Alternatively or in addition, the processor 503 may include one or more microprocessors configured in tandem via the bus 501 to enable independent execution of instructions, pipelining, and multithreading. The processor 503 may also be accompanied with one or more specialized components to perform certain processing functions and tasks such as one or more digital signal processors (DSP) 507, or one or more application-specific integrated circuits (ASIC) 509. A DSP 507 typically is configured to process real-world signals (e.g., sound) in real time independently of the processor 503. Similarly, an ASIC 509 can be configured to performed specialized functions not easily performed by a more general purpose processor. Other specialized components to aid in performing the inventive functions described herein may include one or more field programmable gate arrays (FPGA), one or more controllers, or one or more other special-purpose computer chips.

In one or more embodiments, the processor (or multiple processors) 503 performs a set of operations on information as specified by computer program code related to pairing a fuser assembly with a media size and electronically labeling the fuser assembly for use with the media size. The computer program code is a set of instructions or statements providing instructions for the operation of the processor and/or the computer system to perform specified functions. The code, for example, may be written in a computer programming language that is compiled into a native instruction set of the processor. The code may also be written directly using the native instruction set (e.g., machine language). The set of operations include bringing information in from the bus 501 and placing information on the bus 501. The set of operations also typically include comparing two or more units of information, shifting positions of units of information, and combining two or more units of information, such as by addition or multiplication or logical operations like OR, exclusive OR (XOR), and AND. Each operation of the set of operations that can be performed by the processor is represented to the processor by information called instructions, such as an operation code of one or more digits. A sequence of operations to be executed by the processor 503, such as a sequence of operation codes, constitute processor instructions, also called computer system instructions or, simply, computer instructions. Processors may be implemented as mechanical, electrical, magnetic, optical, chemical or quantum components, among others, alone or in combination.

The processor 503 and accompanying components have connectivity to the memory 505 via the bus 501. The memory 505 may include one or more of dynamic memory (e.g., RAM, magnetic disk, writable optical disk, etc.) and static memory (e.g., ROM, CD-ROM, etc.) for storing executable instructions that when executed perform the inventive steps described herein to pair a fuser assembly with a media size and electronically labeling the fuser assembly for use with the media size. The memory 505 also stores the data associated with or generated by the execution of the inventive steps.

In one or more embodiments, the memory 505, such as a random access memory (RAM) or any other dynamic storage device, stores information including processor instructions for pairing a fuser assembly with a media size and electronically labeling the fuser assembly for use with the media size. Dynamic memory allows information stored therein to be changed by system 100. RAM allows a unit of information stored at a location called a memory address to be stored and retrieved independently of information at neighboring addresses. The memory 505 is also used by the processor 503 to store temporary values during execution of processor instructions. The memory 505 may also be a read only memory (ROM) or any other static storage device coupled to the bus 501 for storing static information, including instructions, that is not changed by the system 100. Some memory is composed of volatile storage that loses the information stored thereon when power is lost. The memory 505 may also be a non-volatile (persistent) storage device, such as a magnetic disk, optical disk or flash card, for storing information, including instructions, that persists even when the system 100 is turned off or otherwise loses power.

The term "computer-readable medium" as used herein refers to any medium that participates in providing information to processor 503, including instructions for execution. Such a medium may take many forms, including, but not limited to computer-readable storage medium (e.g., non-volatile media, volatile media), and transmission media. Non-volatile media includes, for example, optical or magnetic disks. Volatile media include, for example, dynamic memory. Transmission media include, for example, twisted pair cables, coaxial cables, copper wire, fiber optic cables, and carrier waves that travel through space without wires or cables, such as acoustic waves and electromagnetic waves, including radio, optical and infrared waves. Signals include man-made transient variations in amplitude, frequency, phase, polarization or other physical properties transmitted through the transmission media. Common forms of computer-readable media include, for example, a floppy disk, a flexible disk, hard disk, magnetic tape, any other magnetic medium, a CD-ROM, CDRW, DVD, any other optical medium, punch cards, paper tape, optical mark sheets, any other physical medium with patterns of holes or other optically recognizable indicia, a RAM, a PROM, an EPROM, a FLASH-EPROM, an EEPROM, a flash memory, any other memory chip or cartridge, a carrier wave, or any other medium from which a computer can read. The term computer-readable storage medium is used herein to refer to any computer-readable medium except transmission media.

While a number of embodiments and implementations have been described, the invention is not so limited but covers various obvious modifications and equivalent arrangements, which fall within the purview of the appended claims. Although features of various embodiments are expressed in certain combinations among the claims, it is contemplated that these features can be arranged in any combination and order.

What is claimed is:

1. A method useful in printing comprising:

causing, at least in part, a fuser assembly having a memory to be tagged with an identifier related to a corresponding media size, the identifier being stored in the memory;

determining a media size associated with a print job to be run by a printing system;

determining the identifier of an installed fuser assembly; and causing, at least in part, a comparison between the determined media size associated with the print job and the identifier of the installed fuser assembly to determine if a conflict exists.

2. A method of claim 1, further comprising:

determining a conflict exists; and causing, at least in part, an error message to be generated indicating that the conflict exists between the installed fuser assembly and the media size associated with the print job.

3. A method of claim 1, wherein the fuser assembly is tagged with the identifier by way of a user interface.

4. A method of claim 1, wherein the memory is a customer replaceable unit monitor.

5. A method of claim 1, further comprising:

determining the installed fuser assembly is unfit for the media size associated with the tagged identifier; and causing, at least in part, a suggestion message to be generated to use the installed fuser assembly for another media size that is smaller than the media size associated with the tagged identifier.

6. A method of claim 5, further comprising:

causing, at least in part, the fuser assembly to be re-tagged with another identifier related to the another media size, the another identifier being stored in the memory.

7. A method of claim 6, wherein the fuser assembly is re-tagged by way of a user interface.

8. An apparatus useful in printing comprising:

at least one processor; and at least one memory including computer program code for one or more programs, the at least one memory and the computer program code configured to, with the at least one processor, cause the apparatus to perform at least the following, cause, at least in part, a fuser assembly having a memory to be tagged with an identifier related to a corresponding media size, the identifier being stored in the memory;

determine a media size associated with a print job to be run by a printing system;

determine the identifier of an installed fuser assembly; and cause, at least in part, a comparison between the determined media size associated with the print job and the identifier of the installed fuser assembly to determine if a conflict exists.

9. An apparatus of claim 8, wherein the apparatus is further caused to:

determine a conflict exists; and cause, at least in part, an error message to be generated indicating that the conflict exists between the installed fuser assembly and the media size associated with the print job.

10. An apparatus of claim 8, wherein the fuser assembly is tagged with the identifier by way of a user interface.

11. An apparatus of claim 8, wherein the memory is a customer replaceable unit monitor.

12. An apparatus of claim 8, wherein the apparatus is further caused to:

determine the installed fuser assembly is unfit for the media size associated with the tagged identifier; and cause, at least in part, a suggestion message to be generated to use the installed fuser assembly for another media size that is smaller than the media size associated with the tagged identifier.

13. An apparatus of claim 12, wherein the apparatus is further caused to:

cause, at least in part, the fuser assembly to be re-tagged with another identifier related to the another media size, the another identifier being stored in the memory.

14. An apparatus of claim 13, wherein the fuser assembly is re-tagged by way of a user interface.

15. A computer-readable storage medium carrying one or more sequences of one or more instructions which, when executed by one or more processors, cause an apparatus useful in printing to at least perform the following:

cause, at least in part, a fuser assembly having a memory to be tagged with an identifier related to a corresponding media size, the identifier being stored in the memory;

determine a media size associated with a print job to be run by a printing system;

determine the identifier of an installed fuser assembly; and cause, at least in part, a comparison between the determined media size associated with the print job and the identifier of the installed fuser assembly to determine if a conflict exists.

16. A computer-readable storage medium of claim 15, wherein the apparatus is caused to:

determine a conflict exists; and cause, at least in part, an error message to be generated indicating that the conflict exists between the installed fuser assembly and the media size associated with the print job.

17. A computer-readable storage medium of claim 15, wherein the fuser assembly is tagged with the identifier by way of a user interface.

18. A computer-readable storage medium of claim 15, wherein the memory is a customer replaceable unit monitor.

19. A computer-readable storage medium of claim 15, wherein the apparatus is further caused to:

determine the installed fuser assembly is unfit for the media size associated with the tagged identifier; and cause, at least in part, a suggestion message to be generated to use the installed fuser assembly for another media size that is smaller than the media size associated with the tagged identifier.

20. A computer-readable storage medium of claim 19, wherein the apparatus is further caused to:

cause, at least in part, the fuser assembly to be re-tagged with another identifier related to the another media size, the another identifier being stored in the memory.

21. A computer-readable storage medium of claim 20, wherein the fuser assembly is re-tagged by way of a user interface, performing another action.

* * * * *